United States Patent [19]

Randermann, Jr.

[11] 4,100,969

[45] Jul. 18, 1978

[54] TUBING TESTER VALVE APPARATUS

[75] Inventor: Ervin Randermann, Jr., Beasley, Tex.

[73] Assignee: Schlumberger Technology Corporation, New York, N.Y.

[21] Appl. No.: 782,269

[22] Filed: Mar. 28, 1977

[51] Int. Cl.[2] ..... E21B 43/12; F16K 31/16

[52] U.S. Cl. ..... 166/324; 137/629; 137/630.15; 166/334

[58] Field of Search ..... 166/324, 334; 137/629, 137/630.19, 630.15; 251/75, 80, 341, 228

[56] References Cited

U.S. PATENT DOCUMENTS

| | | | |
|---|---|---|---|
| 3,078,923 | 2/1963 | Tausch | 166/324 |
| 3,414,061 | 12/1968 | Nutter | 166/324 |
| 3,470,903 | 10/1969 | Scott | 166/334 |
| 3,845,818 | 11/1974 | Deaton | 166/324 |
| 3,865,141 | 2/1975 | Young | 166/322 |

*Primary Examiner*—James A. Leppink

*Attorney, Agent, or Firm*—David L. Moseley; William R. Sherman; Edward M. Roney

[57] ABSTRACT

In accordance with an illustrative embodiment of the present invention, a valve apparatus adapted to be incorporated in a string of tubing to permit pressure testing thereof in a well bore includes inner and outer members telescopically disposed and movable between extended and contracted relative positions, main valve means for closing the axial flow passage through said members to downward flow in response to extension of the members, and equalizing passage and valve means for equalizing pressures across the main valve prior to reopening thereof in response to contraction of the members.

13 Claims, 6 Drawing Figures

TUBING TESTER VALVE APPARATUS

This invention relates generally to valve apparatus adapted for use in a well bore, and particularly to a new and improved tubing tester valve arranged to be incorporated in a string of tubing being run into a well bore and selectively operable to enable testing the pressure integrity of the string.

Numerous well service and workover operations involve running a packer into a well at the lower end of a tubing string and setting the packer to isolate a zone in the well. Then a substance such as cement slurry, acid or hydraulic fracturing fluid is pumped through the tubing under pressure and into the formation behind the casing through perforations therein below the packer. Of course one important factor in the ultimate success of such an operation lies in having a pressure-tight tubing string.

Thus it is desirable to be able to test the tubing for possible leaks as it is being run into the well. Such testing normally is done at frequent intervals as the tubing sections are being made up at the surface so that if a leak is detected the same can be repaired, or a faulty section of tubing replaced. Typically, valve apparatus is incorporated in the tubing string above the packer and is operable by manipulation of the tubing string to close off same and enable pressurizing a fluid filling the string to determine if it will hold an adequate pressure level. One difficulty that has been encountered in manipulating typical valves is that where the hydrostatic head of the tubing liquid exceeds the pressure head in the casing annulus outside, the valve is difficult to reopen and can be damaged by application of excessive forces thereto.

It is a general object of the present invention to provide a new and improved tubing tester valve apparatus that includes a means for equalizing pressures above and below the closure element prior to reopening whereby such reopening can be accomplished readily and without risk of damage to valve parts.

This and other objects of the present invention are attained through the provision of a tubing tester valve comprising an upper outer member adapted for connection to the tubing and a lower inner member telescopically disposed with respect to said outer member and adapted for connection to a well packer. The members are generally tubular in form to provide an axial flow passage therethrough, and are relatively movable between extended and contracted positions. Coengageable main valve means on said outer member is arranged to close the flow passage against downward flow in response to relative movement of the members to extended positions to enable the tubing string to be pressure tested for leaks, and to open in response to relative movement of the members to contracted position. The apparatus further includes bypass passage and valve means for equalizing pressures across said main valve means prior to opening thereof in response to relative movement of the member to contracted position. Upon substantial pressure equalization, a spring loaded tube on said inner member functions to automatically open said main valve means.

The present invention has other features, objects and advantages which will become more clearly apparent in connection with the following detailed description of a preferred embodiment, taken in conjunction with the appended drawings, in which.

Figure 1:
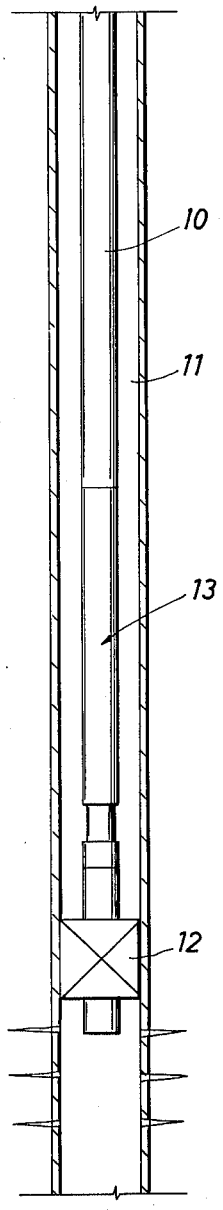
FIG. 1 is a schematic view of a well having a tubing string, tubing tester valve and packer disposed therein.

Referring initially to FIG. 1, there is shown a tubing string 10 extending into a cased well bore 11 and having a conventional well packer 12 attached to its lower end. The well packer 12 is shown only schematically but includes the usual drag blocks, slips and expander cone for anchoring against vertical movement in the casing, and a packing element for sealing off the annulus between the tubing and the casing. A tubing tester valve 13 is incorporated in the tubing string 10 immediately above the packer 12 and is the subject of the present invention.

Figure 2D:
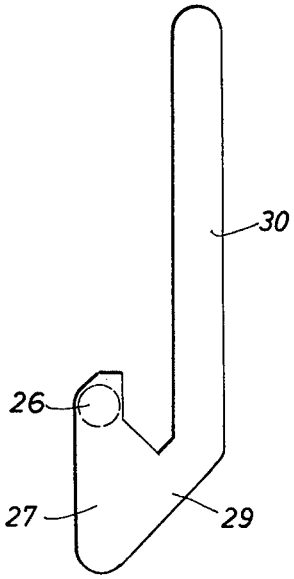
FIG. 2D is a developed plan view of a jay-slot and lug control used to control telescoping movement of members of the apparatus shown in FIGS. 2A–C.
Figure 2A:
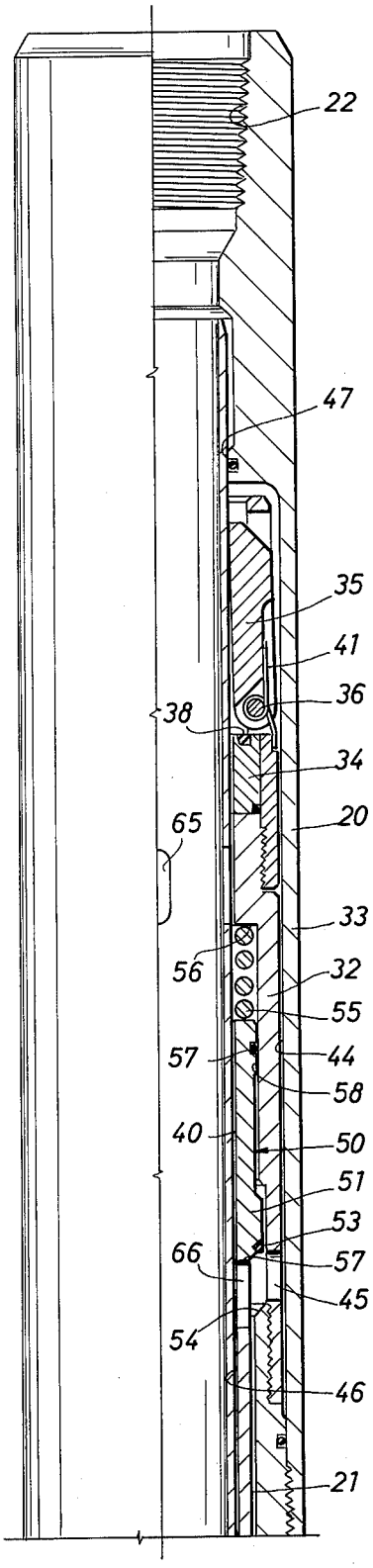
FIGS. 2A, 2B and 2C are longitudinal sectional views, with portions in side elevation, of a tubing tester valve according to the present invention, these successive FIGURES forming lower continuations of one another.
Figure 2B:
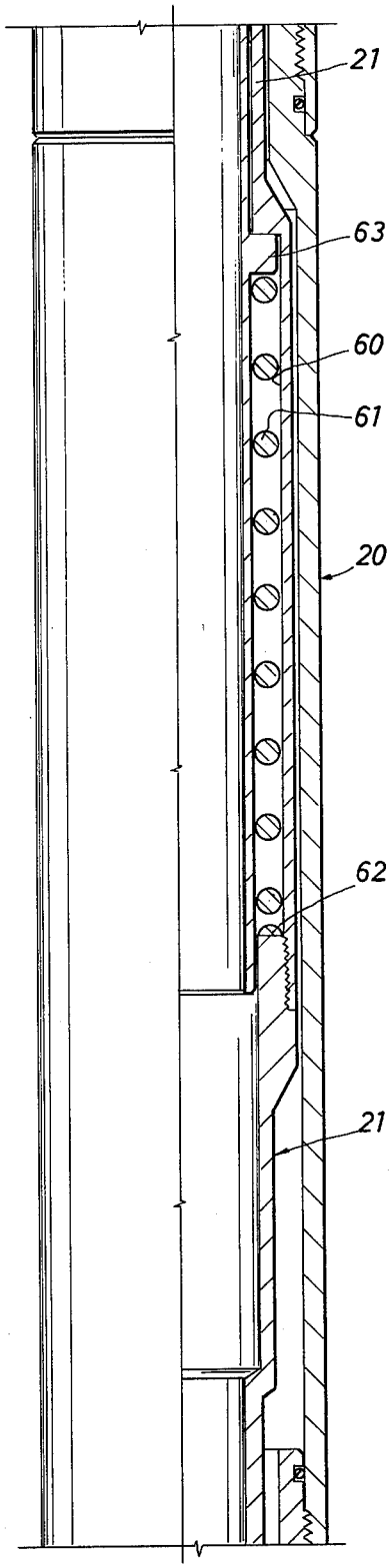
Figure 2C:
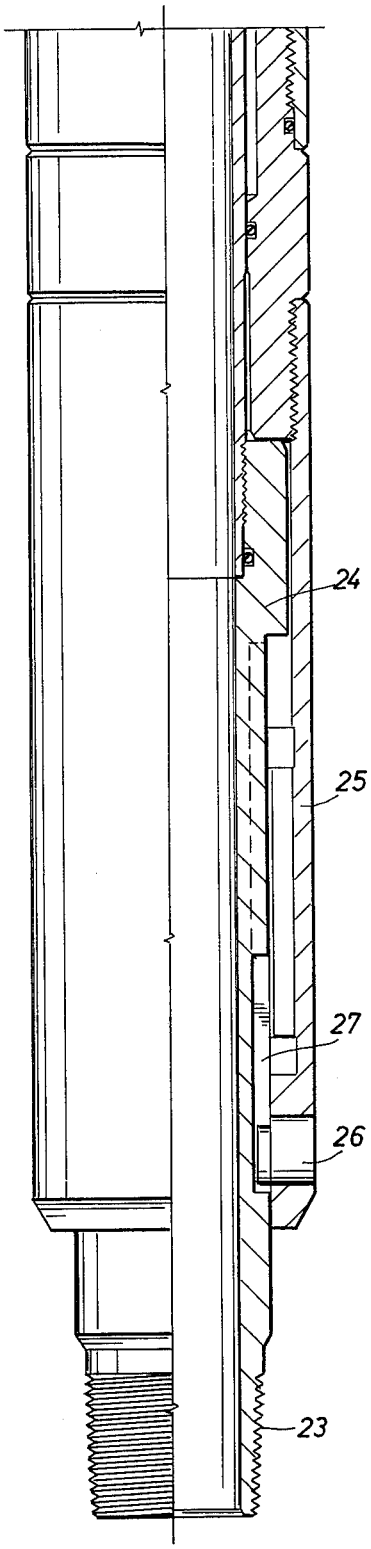

As shown in sectional detail in FIGS. 2A–2C, the tubing tester valve 13 comprises an outer tubular member 20 that is telescopically disposed with respect to an inner tubular member 21 and arranged for vertical relative movement between extended and contracted relative positions. Of course each member may include several threadedly interconnected sections for convenience of manufacture and assembly. The outer member 20 has threads 22 at its upper end for attachment to the lower end of the tubing 10, whereas the inner member 21 has threads 23 at its lower end for attachment either directly or through the intermediary of other well tools to the packer 12.

The lower sub 24 of the inner member 21 has a "jay-slot" with the configuration shown in FIG. 2D formed in the outer periphery thereof, and the lower sub 25 of the outer member 20 carries a pin or lug 26 that coacts with the slot to control relative longitudinal movement. When the lug 26 is disposed in the short vertical section 27 of the slot 28, the members 20 and 21 are held in the contracted positions as shown in FIGS. 2A–2C. On the other hand should the outer member 20 be subjected to right-hand torque and lifted upwardly, the pin 26 will be moved via the inclined slot segment 29 into the elongated vertical portion 30 so that the members 20 and 21 can be extended substantially relative to each other.

Referring again to FIG. 2A, an inner section 32 of the outer member 20 is spaced laterally inwardly of an upper section 33 thereof and carries near its upper end a valve seat ring 34 which surrounds the flow passage through the members. An annular flapper valve element 35 is hinged by a pin 36 or the like to the section 32 and can pivot between an open position, as shown, and a position transverse to the flow passage 37 where the element closes downwardly against a seal ring 38 bonded in a circular groove in the seat ring 34. Normally, that is to say when the members 20 and 21 are in the contracted relative position, a valve actuator tube 40 is extended upwardly through the seat ring 34 and thus holds the valve element 35 in the open position. With the tube 40 withdrawn downwardly through the seat ring 34, however, a hinge spring 41 which biases the element 35 toward closed position can cause the element to pivot downwardly into engagement with the seat ring.

The lateral spacing of the sections 32 and 33 as mentioned above provides an annular flow passage 44 extending past the valve element and seat 35, 34. The lower end of the passage 44 is communicated by one or more ports 45 with the bore 46 of the inner member 21, and the upper end of the passage is communicated by vertical spacing on the assembled parts with the bore 47 of the outer member 20. A valve sleeve 50 having a valve head 51 at its lower end is slidable between the section 32 and the actuator tube 40 between an upper open position as shown in FIG. 2A where the same is held in such position by abutment with an upper end surface 57 of the inner member 21, and a lower position where a seal element 53 bonded to the head 51 engages a seat surface 54 to close off downward flow through the passage 44. The valve sleeve 50 is biased downwardly by a coil spring 55 reacting between its upper end and a downwardly facing shoulder 56 on the section 32. An O-ring 57 on the upper portion of the valve sleeve 50 is sealingly slidable against the inner wall surface 58 of the section 32 on a lesser diameter than the diameter of sealing engagement of the seal element 53 against the surface 54.

Noting FIG. 2B, the inner tubular member 21 is provided with an elongated internal recess 60 in which is positioned a coil spring 61 which reacts between an upwardly facing shoulder 62 thereon and an outwardly directed shoulder 63 integral with the actuator tube 40. The spring 61 biases the tube 40 upwardly and functions to force the upper portion of the tube through the seat ring 34 to effect opening of the valve element 35 under certain circumstances of relative part positions and pressure conditions as will be explained subsequently. One or more flow ports 65 are provided in the wall of the actuator tube 40 and are located for radial alignment with the ports 45 at the lower end of the passage 44 in the extended relative position of the members 20 and 21.

Figure 3:
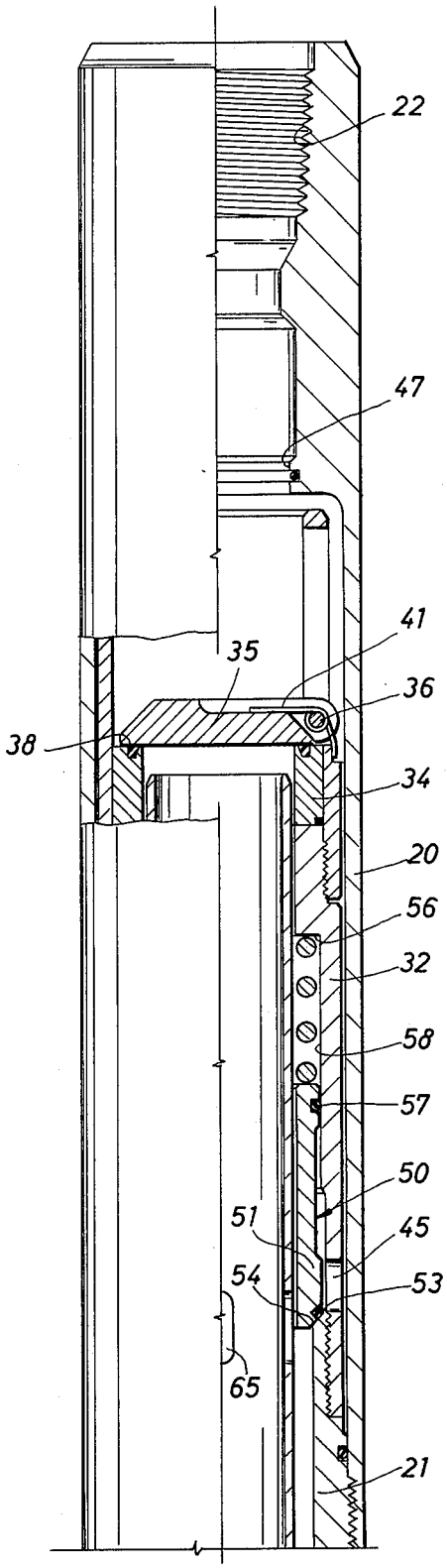
FIG. 3 is a view similar to FIG. 2A but with the tubing tester valve in the closed position.

In operation, the tubing tester valve apparatus 13 assembled as shown in the drawings is connected at the lower end of the tubing string 10 and lowered with the packer 12 into the well bore 11. During downward movement, the lug 26 is within the short segment 27 of the jay-slot 28 to lock the members against extension and so that the flapper and bypass valve elements 35 and 50 are in the open positions illustrated in FIGS. 2A and 2B. When it is desired to test the capability of the tubing string 10 to hold pressure, at the surface the tubing is torqued to the right and picked up. The drag blocks of the packer 12 hold the inner member 21 stationary in the well, so that the outer member 20 is moved upwardly relative to the inner member as the control pin 26 moves through the elongated vertical slot 30. Such elevation of the outer member 20 positions the flapper valve element 35 above the upper end of the actuator tube 40 and enables the element to pivot downwardly and close against the seat ring 34. Such upward movement also enables the bypass valve sleeve 50 to be shifted downwardly by its actuator spring 55 to its closed position where the head 51 engages the seat surface 54. The foregoing relative position of parts is shown in FIG. 3.

With the valve elements 35 and 50 in closed condition, pressure is applied at the surface to fluid filling the tubing 10 in order to detect the presence or absence of leaks. Such pressure holds the valve element 35 tightly closed, and also acts downwardly on the bypass valve sleeve 50 across the difference in areas circumscribed by the seals 53 and 57. To reopen the tester valve 13, the tubing 10 is lowered to effect downward movement of the outer member 20 relative to the inner member 21. If the flapper valve element 35 is subject to a pressure differential from above acting to hold the element firmly against the seat ring 34, which would be the case, for example, in low fluid-level wells when the hydrostatic head of fluids in the casing at the level of the valve 13 is less than that of the fluids in the tubing immediately above the valve 13, the valve still may be opened easily as follows. As the outer member 20 is lowered relative to the inner member 21, the actuator tube 40 can shift downwardly with the outer member 20 against the bias afforded by the coil spring 61. Near the fully contracted position of the members 20 and 21, the upper end surface of the inner member 21 engages the valve sleeve 50 and forces it relatively upwardly to open position. This enables fluids to bypass the flapper element 35 via the passage 44, the ports 45, the slots 66, and tube ports 65, to effect equalization of pressures across the flapper element. As the pressures equalize, the coil spring 61, having previously been compressed by downward movement of the tube 40, forces the upper end of the tube through the seat ring 34 and causes the flapper valve element 35 to pivot to open position. The parts of the valve assembly 13 then are returned to the normal relative positions shown in FIGS. 2A–2C, whereupon further pressure tests may be accomplished as additional sections of tubing are added to the string at the surface.

It now will be recognized that a new and improved tubing tested valve has been provided which features pressure equalization across the main closure element prior to reopening thereof. Since certain changes and modifications may be made in the disclosed embodiment by those skilled in the art without departing from the inventive concepts involved, it is the aim of the appended claims to cover all such changes and modifications falling within the true spirit and scope of the present invention.

I claim:

1. Valve apparatus adapted for use in a well, comprising: inner and outer tubular members telescopically disposed and arranged for relative movement between extended and contracted positions, said members defining a flow passage; first valve means responsive to relative movement of said members to extended position for closing said flow passage to downward flow of fluids; second valve means for equalizing pressures in said flow passage above and below said first valve means; means engageable with said second valve means in response to relative movement of said members to contracted position for shifting said second valve means to open position; and spring-loaded actuator means also responsive to movement of said members to said contracted position for opening said first valve means subsequent to the opening of said second valve means.

2. The apparatus of claim 1 wherein said first valve means includes a valve seat surrounding said flow passage, and a valve element arranged to close downwardly against said valve seat to prevent downward flow of fluids through said flow passage.

3. The apparatus of claim 2 wherein said second valve means includes a fluid passageway extending between locations in communication with said flow passage above and below said valve seat, and a sleeve valve element for opening and closing said fluid passageway.

4. The apparatus of claim 3 wherein said shifting means includes surface means on said inner member arranged for abutting engagement with said sleeve valve element, and further including spring means for biasing said sleeve valve element toward closed position.

5. The apparatus of claim 4 wherein said actuator means is movable relatively along said inner member and is extendible upwardly through said valve seat to effect opening of said first valve means, and includes spring means that is compressed by relative movement of said members to said contracted position for urging upward movement of said actuator means.

6. The apparatus of claim 1 further including releasable means for holding said members in said contracted relative position.

7. Tubing tester valve apparatus adapted for use in pressure testing a tubing string in a well, comprising: an upper outer member; a lower inner member telescopically disposed with respect to said outer member; said members defining an axial flow passage and being movable between extended and contracted relative positions; coengageable first valve means on said outer member for closing said flow passage against downward flow therethrough in response to extension of said members; means on said inner member for opening said first valve means in response to contraction of said members; a bypass passage in said outer member extending past said first valve means; second valve means for opening said bypass passage in response to contraction of said members to effect equalization of pressures above and below said main valve means prior to opening thereof; and spring loaded means responsive to said contraction of said members for actuating said second valve means.

8. The apparatus of claim 7 wherein said first valve means includes a valve seat ring surrounding said flow passage, and a hinged flapper valve element pivotally mounted on said outer member and arranged to close downwardly against said valve seat ring.

9. The apparatus of claim 8 wherein said actuating means comprises a tube slidably mounted on said inner member and having an upper end portion extendible through said valve seat ring, and a coil spring reacting between said inner member and said tube for urging said upper portion through said seat ring.

10. The apparatus of claim 7 wherein said second valve means includes a sleeve valve element sealingly slidable with respect to said outer member and being movable downwardly with respect thereto for closing said bypass passage, and surface means on said inner member for shifting said sleeve valve element upwardly to open position.

11. The apparatus of claim 10 wherein said sleeve valve element has a transverse pressure area subject to the pressure of fluids in said flow passage above said first valve means for holding said valve element in closed position in response to a predominance of said pressure.

12. The apparatus of claim 11 further including spring means for continuously urging said sleeve valve element toward closed position.

13. The apparatus of claim 7 further including releasable means for holding said members in said contracted relative position during longitudinal movement of said apparatus in a well bore.

* * * * *